US011703259B2

(12) United States Patent
Kumar

(10) Patent No.: US 11,703,259 B2
(45) Date of Patent: Jul. 18, 2023

(54) WATER-COOLED HEAT EXCHANGER

(71) Applicant: Munish Kumar, Gurugram (IN)

(72) Inventor: Munish Kumar, Gurugram (IN)

(73) Assignee: Carrier Corporation, Palm Beach Gardens, FL (US)

( * ) Notice: Subject to any disclaimer, the term of this patent is extended or adjusted under 35 U.S.C. 154(b) by 32 days.

(21) Appl. No.: 17/305,743

(22) Filed: Jul. 14, 2021

(65) Prior Publication Data

US 2022/0026124 A1 Jan. 27, 2022

Related U.S. Application Data

(60) Provisional application No. 62/705,890, filed on Jul. 21, 2020.

(51) Int. Cl.
*F25B 43/02* (2006.01)

(52) U.S. Cl.
CPC ..... *F25B 43/02* (2013.01)

(58) Field of Classification Search
CPC ..... F25B 31/004; F25B 43/003; F25B 43/02; F25B 2339/047; F25B 2400/23
USPC ..... 62/470
See application file for complete search history.

(56) References Cited

U.S. PATENT DOCUMENTS

| | | | | |
|---|---|---|---|---|
| 4,317,662 | A | 3/1982 | Hudson | |
| 5,704,215 | A | 1/1998 | Lord | |
| 6,187,079 | B1 | 2/2001 | Bridger | |
| 2006/0196220 | A1 * | 9/2006 | Westermeyer | F25B 43/02 62/84 |

FOREIGN PATENT DOCUMENTS

WO 2019232187 12/2019

* cited by examiner

*Primary Examiner* — Henry T Crenshaw
*Assistant Examiner* — Kamran Tavakoldavani

(57) ABSTRACT

A water-cooled heat exchanger with oil separator having integrated refrigerant distribution, the oil separator, including: an exterior shell having opposite end walls defining a first interior, and a first and second opening fluidly communicative with the first interior; a plurality of baffles operably coupled to and extending from at least a first opposite end wall, each baffle including a first support member generally parallel to a second support member, each operably coupled in a generally perpendicular orientation, to at least the first opposite end wall, and a crossmember operably coupled between a first and second support member, the crossmember having a width dimension that is less than the width of the first support member and the second support member, forming an orifice between the crossmember and the at least first opposite end wall; and a distributor integrated within the exterior shell to define a second interior within the first interior.

20 Claims, 5 Drawing Sheets

WATER-COOLED HEAT EXCHANGER

CROSS REFERENCE TO A RELATED APPLICATION

The application claims the benefit of U.S. Provisional Application No. 62/705,890 filed Jul. 21, 2020, the contents of which are hereby incorporated in their entirety.

BACKGROUND

The following description relates to water-cooled heat exchangers and more specifically, water-cooled heat exchangers with an oil separator having integrated refrigerant distribution.

A chiller is a machine that removes heat from a liquid via a vapor-compression or absorption refrigeration cycle. This liquid can then be circulated through a heat exchanger to cool equipment, or another process stream (such as air or process water). A typical chiller includes a compressor (e.g., a screw compressor), a condenser, an evaporator or cooler, an oil-refrigerant separator, an economizer and expansion devices. These components are connected to each other by tubing that carries a working fluid (e.g., refrigerant) through the chiller system. The evaporator typically includes a plurality of tubes that circulate water to be cooled. The condenser typically includes a plurality of tubes through which is circulated tower water to which heat is rejected. The compressor requires oil for lubrication which is typically entrained in the refrigerant. The combined oil and refrigerant mixture is carried through the compression cycle and then discharged into the oil separator where the oil must be removed from the refrigerant to allow for proper operation of the heat exchangers. The separated refrigerant is supplied to condenser and separated oil is returned to the compressor. From the oil separator, the clean refrigerant flows to the condenser.

In some chiller systems, the oil separator is integrated with a heat exchanger (e.g., a condenser) which provides for among other things, a manufacturing cost savings. Some integrated oil separators may include an off-centered refrigeration inlet, and a distributor for distributing the oil/refrigerant mixture into the body of the oil separator. Such oil separators may also include filtration devices such as wire mesh and demister pads for separating the incoming oil/refrigerant mixture. In general, separation occurs by the collision of the oil and refrigerant mixture on the walls of the oil separator. The oil is further separated from the mixture due to gravity and the filtration. When refrigerant enters the oil separator it may impinge on the side walls of the oil separator, and if the distribution of refrigerant is uneven, then oil separation efficiency may be reduced. In addition, if the flow within the oil separator body is non-uniform as it enters the filtration devices, then separation efficiency may be further reduced and permit oil particles to remain in the refrigerant as the refrigerant flows to the compressor. This in turn reduces the efficiency of the HVAC system and may lead to reliability and quality issues. What is needed then, is a system and method for improving the flow and distribution of refrigerant within an integrated oil separator, having off-centered refrigerant inlet.

BRIEF DESCRIPTION

According to one non-limiting embodiment, an oil separator including: an exterior shell having opposite end walls defining a first interior, and a first and second opening fluidly communicative with the first interior; a plurality of baffles operably coupled to and extending from at least a first opposite end wall, each baffle comprising: a first support member generally parallel to a second support member, each operably coupled, and in an orientation that is generally perpendicular, to at least the first opposite end wall, and a crossmember operably coupled between the first support member and the second support member, the crossmember having a width dimension that is less than the width dimension of the first support member and the second support member, forming an orifice between the crossmember and the at least first opposite end wall; and a distributor integrated within the exterior shell to define a second interior within the first interior.

In addition to one or more of the features described above, or as an alternative, in further embodiments, the oil separator wherein at least one of the crossmember, the first support member and the second support member comprises a concave surface for deflecting the flow of a fluid.

In addition to one or more of the features described above, or as an alternative, in further embodiments, the oil separator wherein the internal width of the orifice between the support members comprises a dimension of less than or equal to about 45 millimeters.

In addition to one or more of the features described above, or as an alternative, in further embodiments, the oil separator wherein the internal depth of the orifice between the crossmember and the at least first opposite end wall comprises a dimension of less than or equal to about 20 millimeters.

In addition to one or more of the features described above, or as an alternative, in further embodiments, the oil separator wherein the width of the baffle across the support members and the crossmember comprise a dimension of less than or equal to about 75 millimeters.

In addition to one or more of the features described above, or as an alternative, in further embodiments, the oil separator wherein the length of a support member comprises a dimension of less than or equal to about 40 millimeters.

In addition to one or more of the features described above, or as an alternative, in further embodiments, the oil separator wherein the distributor having a length, which is slightly less than that of the exterior shell, being disposed to define opposite spaces between a first opposite end and a second opposite end thereof and the opposite end walls and being sealed to the exterior shell along the length to form first and second passageways from the first opening to the opposite spaces.

In addition to one or more of the features described above, or as an alternative, in further embodiments, the oil separator wherein a first filter media cartridge and a second filter media cartridge are disposed within the first interior between the opposite spaces and the second opening.

According to one non-limiting embodiment, a flow component for an oil separator including: an end wall defining an exterior shell of an oil separator having an integrated distributor disposed within the oil separator; and a plurality of baffles operably coupled to and extending from the end wall, each baffle comprising a first support member generally parallel to a second support member, each operably coupled, and in an orientation that is generally perpendicular, to the at least the first opposite end wall, and a crossmember operably coupled between the first support member and the second support member, the crossmember having a width dimension that is less than the width dimension of the first support member and the second support member, forming an orifice between the crossmember and the at least first opposite end wall.

In addition to one or more of the features described above, or as an alternative, in further embodiments, the flow component wherein at least one of the crossmember, the first support member and the second support member comprises a concave surface for deflecting the flow of a fluid.

In addition to one or more of the features described above, or as an alternative, in further embodiments, wherein at least one of the crossmember, the first support member and the second support member comprises a concave surface for deflecting the flow of a fluid.

In addition to one or more of the features described above, or as an alternative, in further embodiments, the flow component wherein the internal width of the orifice between the support members comprises a dimension of less than or equal to about 45 millimeters.

In addition to one or more of the features described above, or as an alternative, in further embodiments, the flow component wherein the internal depth of the orifice between the crossmember and the at least first opposite end wall comprises a dimension of less than or equal to about 20 millimeters.

In addition to one or more of the features described above, or as an alternative, in further embodiments, the flow component wherein the width of the baffle across the support members and the crossmember comprise a dimension of less than or equal to about 75 millimeters.

In addition to one or more of the features described above, or as an alternative, in further embodiments, the flow component wherein the length of a support member comprises a dimension of less than or equal to about 40 millimeters.

According to one non-limiting embodiment, a chiller assembly, including: a compressor; an oil separator including, an exterior shell having opposite end walls defining a first interior, and a first and second opening fluidly communicative with the first interior, a plurality of baffles operably coupled to and extending from at least a first opposite end wall, each baffle comprising: a first support member generally parallel to a second support member, each operably coupled, and in an orientation that is generally perpendicular, to the at least the first opposite end wall, and a crossmember operably coupled between the first support member and the second support member, the crossmember having a width dimension that is less than the width dimension of the first support member and the second support member, forming an orifice between the crossmember and the at least first opposite end wall; and a distributor integrated within the exterior shell to define a second interior within the first interior.

In addition to one or more of the features described above, or as an alternative, in further embodiments, the chiller assembly including a single discharge pipe sub-assembly fluidly interposed between the compressor and the oil separator.

In addition to one or more of the features described above, or as an alternative, in further embodiments, the chiller assembly wherein the distributor comprises a cross-sectional area which is substantially similar to that of the single discharge pipe sub-assembly.

In addition to one or more of the features described above, or as an alternative, in further embodiments, the chiller assembly wherein the internal width of the orifice between the support members comprises a dimension of less than or equal to about 45 millimeters.

In addition to one or more of the features described above, or as an alternative, in further embodiments, the chiller assembly wherein the internal depth of the orifice between the crossmember and the opposite end wall comprises a dimension of less than or equal to about 20 millimeters.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION

As will be described below, an integrated oil separator is provided with a distributor such that fluid (e.g., an oil/refrigerant mixture) distribution occurs within the elongated body of the oil separator interior. The oil separator is defined by opposing end walls in fluid communication with the distributor. In general, fluid will flow from a discharge pipe of a compressor into an inlet port of the oil separator, which is integrated with a heat exchanger shell, such as a condenser. In some embodiments, the inlet port may be in an off-centered position (e.g., on either side from center of the oil separator). As fluid flows into the oil separator, the distributor will distribute the fluid into one or both ends of the oil separator in the flow direction of the opposing end walls.

Typically, the end walls of an oil separator have a generally flat surface; however when combined with the off-centered positioning of the inlet port, this may result in a non-uniform flow pattern and the creation of unwanted flow vortices within the body of the oil separator. By operably coupling a plurality of baffles to at least one opposing end wall to deflect the flow of fluid as it flows from the distributor into the oil separator body, the fluid flow velocity into the oil separator, before entering the filtration devices (e.g., mesh and demister pads) may be reduced, resulting in improved flow, a reduced occurrence of flow vortices, and with a negligible impact on total pressure drop within the oil separator. The benefits of deflecting flow within the oil separator body using a plurality of baffles will be described below.

Figure 1:
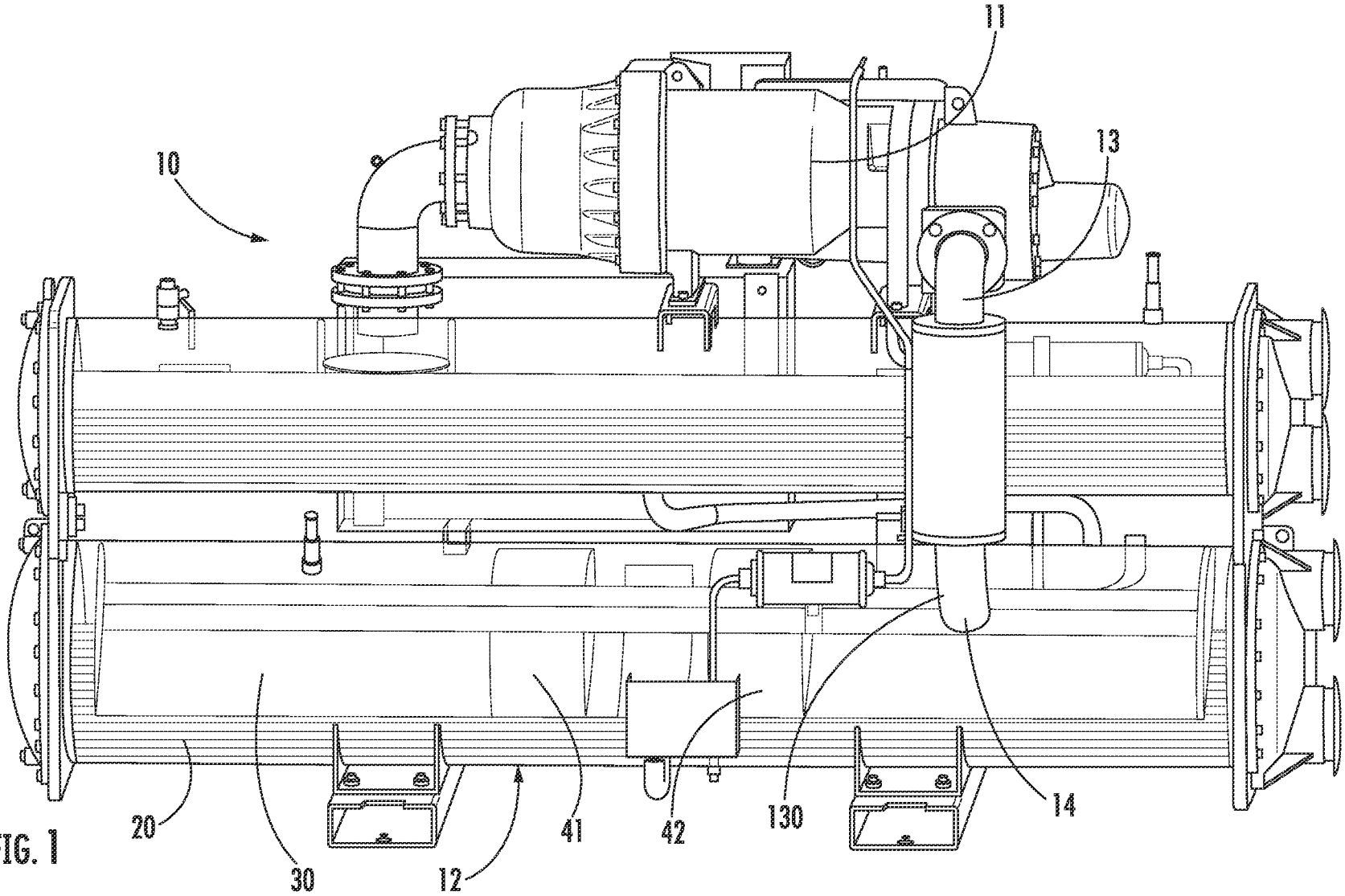
FIG. 1 is a side view of a chiller assembly in accordance with embodiments of the disclosure.

With reference to FIG. 1, a chiller assembly 10 is provided. The chiller assembly 10 includes a compressor 11, an oil separator 12 and a single discharge pipe sub-assembly 13. The compressor 11 is configured to compress refrigerant and to discharge the compressed refrigerant at an initial pressure to the single discharge pipe sub-assembly 13. The single discharge pipe sub-assembly 13 is fluidly interposed between the compressor 11 and the oil separator 12 and conveys the compressed refrigerant at the initial pressure from the compressor 11 to the oil separator 12. The single discharge pipe sub-assembly 13 may be formed of steel or other similar or suitable materials and includes a weld joint 14 at an interface between an end 130 thereof and the oil separator 12.

Figure 2:
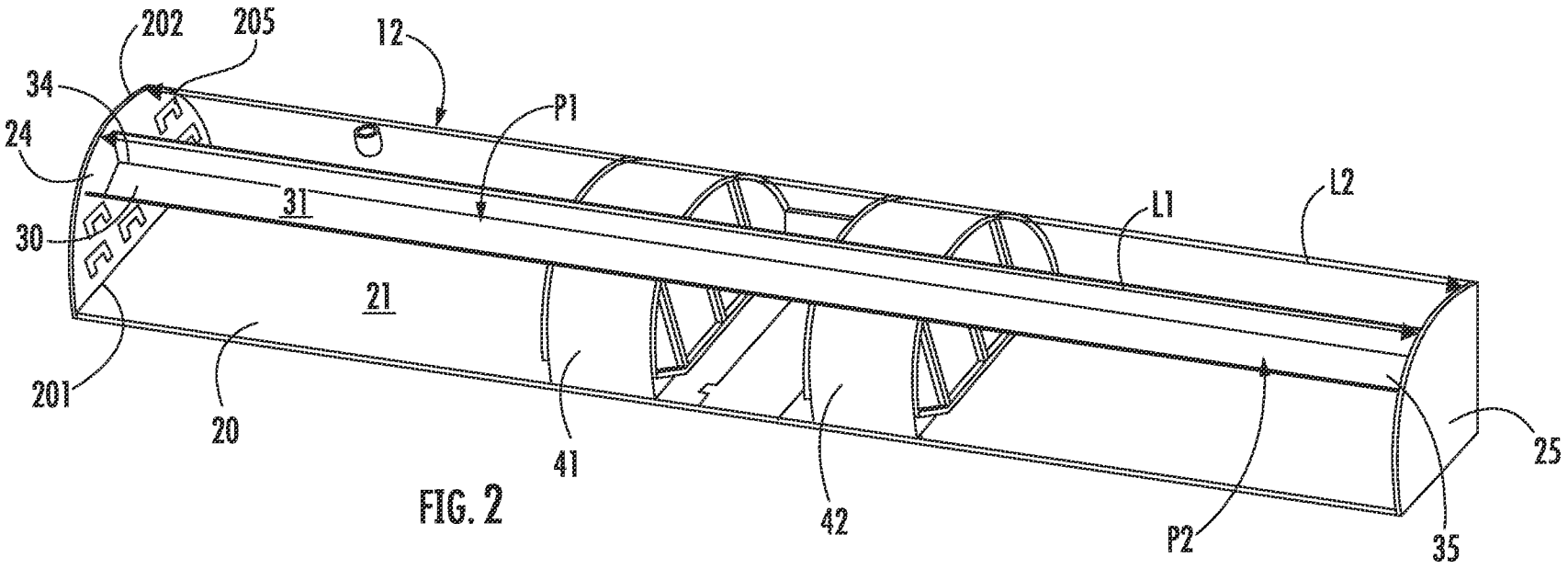
FIG. 2 is a perspective view of an oil separator of the chiller assembly of FIG. 1 in accordance with embodiments of the disclosure.

As shown in FIG. 1 and with additional reference to FIG. 2, the oil separator 12 includes an exterior shell 20, a distributor 30 and first and second filter media cartridges 41 and 42. The distributor 30 is integrated within the exterior shell 20 and has a cross-sectional area which is substantially similar to the cross-sectional area of the single discharge pipe sub-assembly 13. In some embodiments, the distributor internal cross-section size will be equal to the discharge pipe size so that the integrated oil separator 12 will induce no additional pressure drop or change in thermal properties of the refrigerant. The integrated oil separator assembly with the compressor 11 will also be characterized in that copper pipes of conventional chillers will be replaced with a steel pipe. Similarly, silver brazing process that are used with conventional assemblies may be replaced with welding.

Figure 3:
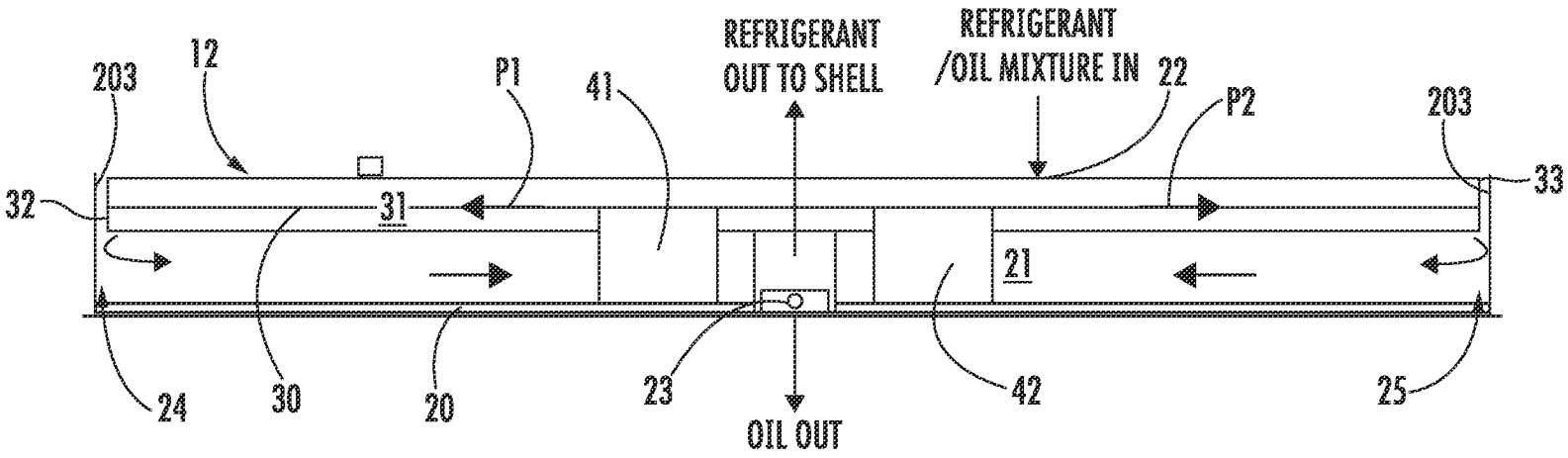
FIG. 3 is a side view of the oil separator in accordance with embodiments of the disclosure.

With continued reference to FIG. 2 and with additional reference to FIG. 3, the exterior shell 20 is formed to define a first interior 21, a first opening 22, which is fluidly communicative with the first interior 21 and a second opening 23, which is also fluidly communicative with the first interior 21. In addition to the second opening 23, which may be an oil outlet, the exterior shell 20 also includes a separate refrigerant outlet configured to allow oil and the refrigerant to separately flow from the oil separator.

The distributor 30 is integrated within the exterior shell 20 to define a second interior 31 within the first interior 21. The distributor 30 has a longitudinal length L1, which is slightly less than a longitudinal length L2 of the exterior shell 20. The distributor 30 is disposed within the exterior shell 20 to thus define opposite spaces 32, 33 between opposite ends 34, 35 of the distributor 30 and corresponding distributor opposite ends 24, 25 of the exterior shell 20. The distributor 30 is also sealed to the exterior shell 20 by seals (not shown) that extend along the edges of the distributor 30 along an entirety of the length L1. The distributor 30 thus forms first and second passageways P1 and P2 from the first opening 22 to the opposite spaces 32, 33. First and second filter media cartridges 41, 42 are respectively disposed within the first interior 21 between corresponding ones of the opposite spaces 32, 33 and the second opening 23.

Figure 4:
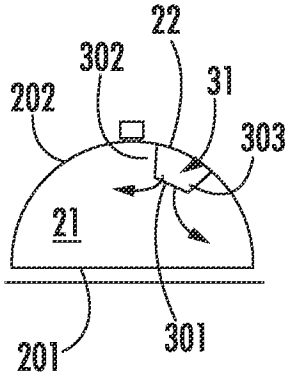
FIG. 4 is a partial axial view of the distributor of the oil separator in accordance with embodiments of the disclosure.

With continued reference to FIG. 3 and with additional reference to FIG. 4, the exterior shell 20 may have a substantially semi-circular cross-sectional shape and may include a flat side 201, a curved side 202 that protrudes away from the flat side 201 and opposite end walls 203. The opposite end walls 203 are provided at respective opposite ends of the flat side 201 and the curved side 202. The flat side 201, the curved side 202 and the opposite end walls 203 cooperatively define the first interior 21. At least one of the opposite end walls 203 may have a plurality of baffles 205 as further described below in reference to FIGS. 5-7. In some embodiments, the cross-sectional area of the distributor 30 is substantially similar to the cross-sectional area of the single discharge pipe sub-assembly 13, such that fluid moving through the single discharge pipe sub-assembly 13 at the initial pressure moves through the distributor 30, the opposite spaces 32, 33 and into the first interior 21 after interacting with baffles 205, without experiencing a pressure drop. That is, the fluid passes through the opposite spaces 32, 33 at substantially a same pressure as the initial pressure.

Referring to FIG. 3 and FIG. 4, a view of the oil separator 12 and distributor 30 is provided, however omitting the plurality of baffles 205, for clarity. The distributor may have a substantially trapezoidal shape (with the curved side 202) serving as one of the trapezoidal sides or other similar shapes to be described in greater detail below. The distributor 30 may include a base 301, sidewalls 302, 303 that extend in a same direction from opposite edges of the base 301. The distributor 30 is disposed within the first interior 21 at an offset position relative to a mid-line of the exterior shell 20 such that the sidewalls 302, 303 extend in the same direction from the opposite edges of the base 301 toward an interior surface of the curved side 202 of the exterior shell 20. Seals may be sealably interposed between distal edges of the sidewalls 302, 303 and the interior surface of the curved side 202. Respective widths of the sidewalls 302, 303 dispose the base 301 at a depth from the interior surface of the curved side 202. The base 301, the sidewalls 302, 303 and the curved side 202 thus define the second interior 31.

As shown in FIGS. 3 and 4, fluid received by the oil separator 12 includes a mixture of refrigerant and oil that was compressed in the compressor 11 and conveyed to the oil separator 12 through the single discharge pipe sub-assembly 13. The fluid enters the exterior shell 20 via first opening 22 and is contained within the sealed second interior 31. The fluid thus moves through either the first or the second passageways P1 and P2 within the second interior 31 and along the length L1 of the distributor 30 as the seals prevent the fluid from flowing in any other direction. Once the fluid that has moved through either the first passageway P1 or the second passageway P2, the fluid reaches the opposite spaces 32, 33. The fluid then passes through the opposite spaces 32, 33 and turns back into the first interior 21 due to interactions with the opposite end walls 203 and baffles 205, and flows through the first and second filter media cartridges 41, 42 toward the second opening 23.

Figure 5:
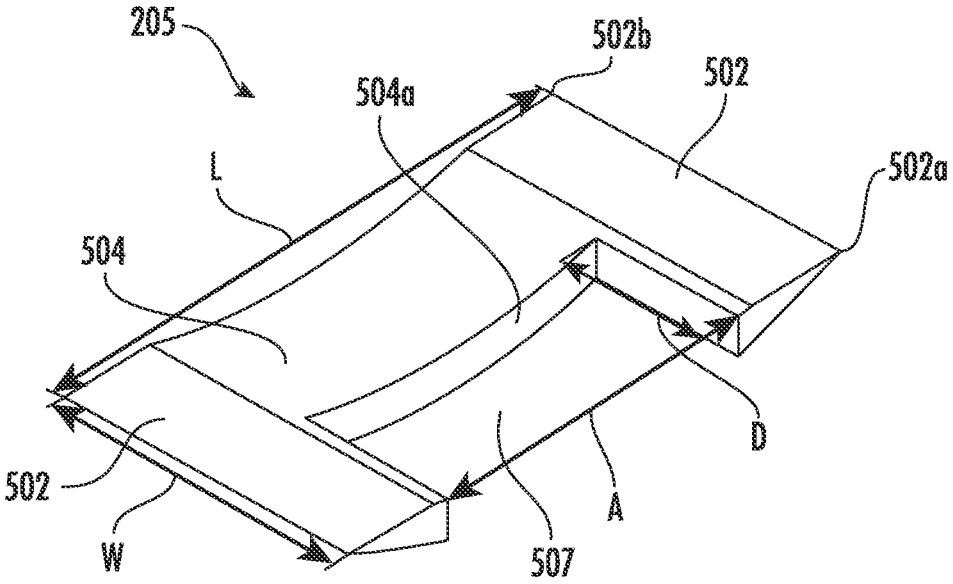
FIG. 5 is a perspective view of a baffle of an oil separator in accordance with embodiments of the disclosure.
Figure 6:
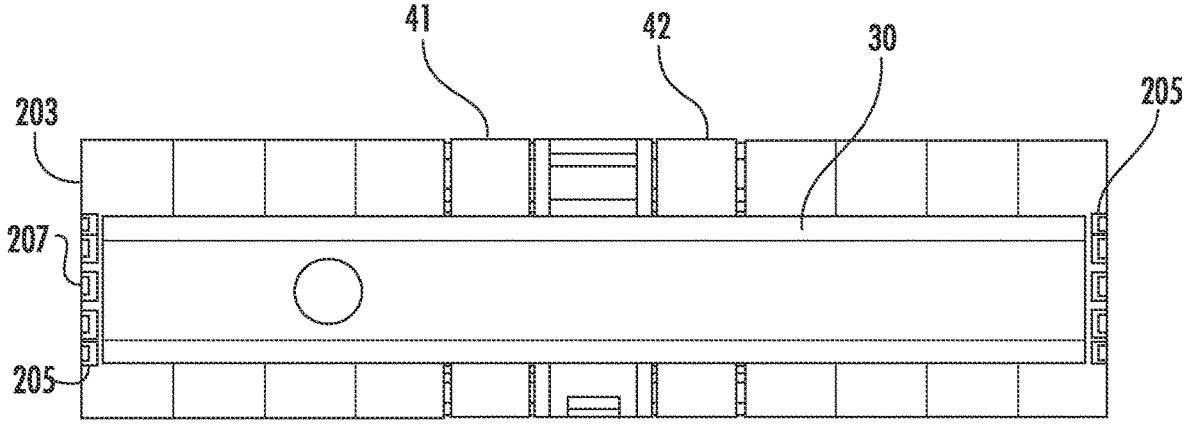
FIG. 6 is a top view of the oil separator in accordance with embodiments of the disclosure.

A baffle 205 in accordance with embodiments of the disclosure, is shown in FIG. 5. Deflecting the flow of fluid using a plurality of baffles 205 has the benefit of reducing the formation of flow vortices that can occur in the first interior 21, and which will also cause a lack of fluid distribution uniformity in the first interior 21. When distribution of fluid is non-uniform, the flow distribution of fluid across the filter media cartridges 41, 42 is reduced. In some embodiments, the filter media cartridges 41, 42 are wire mesh (e.g., demister). When flow distribution is reduced, the filter media cartridges 41, 42, which aid in oil/refrigerant separation, may be less efficient. The flow distribution index (FDI) may be used to obtain the deviation from the average flow velocity. If the flow is perfectly uniform, then FDI is close to 1, otherwise it is less than 1. In general, an oil separator with internal distributor, but without the disclosed baffles, may have an average FDI at the entrance to the wire mesh/demister pads equal to or greater than 0.6 and equal to or less than 0.8. By including a plurality of baffles 205 as disclosed, the FDI may be improved, indicating better distribution of flow.

Each baffle 205 may include a pair of support members 502, 503, wherein a first support member 502 is generally parallel to a second support member 503, each operably coupled, and in an orientation that is generally perpendicular, to at least the first opposite end wall, and a crossmember 504 operably coupled between the first support member 502 and the second support member 503, the crossmember 504 having a width dimension that is less than the width dimension of the first support member 502 and the second support member 503, forming an orifice between the crossmember 504 and the at least first opposite end wall 203.

Baffle 205 may be constructed from, and coupled to the at least one opposite end wall 203 by, any material, preferably metal or metal alloy, that may withstand the fluid forces of fluid acting upon the baffles 205. A baffle 205 may be of any shape that serves to interact with fluid so as to reduce the effect of flow vortices that may occur within the first interior 21, as fluid flows from the distributor 30 through the opposite spaces 32, 33 and into the first interior 21. In addition, a baffle 205 may have any dimension (length, width, depth) depending on a variety of factors, such as size of the oil separator 12 and/or the rate of fluid flow through the oil separator.

In one non-limiting embodiment, baffle 205 has a square U-shape, including two support members 502, 503 extending from an operably coupled crossmember 504. In one non-limiting embodiment, at least one of the crossmember 504 and the support members 502, 503 have a concave surface for deflecting fluid flowing from the distributor 30 into the first interior 21. For example, baffles 205 positioned in proximity to the first opening 22, may deflect approximately 30-40% of fluid flow from the distributor 30, with the remaining portion flowing directly into the first interior 21. For example, flow distribution of fluid in the first interior 21 may be measured (e.g., flow distribution index (FDI)) with higher values indicating improved (e.g., more uniform) flow distribution. For example, an oil separator 12 without deflecting baffles 205 may have a FDI of less than 0.50, while an oil separator 12 with deflecting baffles 205 may have a higher FDI (e.g., equal to or greater than 0.60).

Each support member 502, 503 has a proximal end (e.g., 502*a*) that operably couples the baffle 205 to the at least one opposite end wall 203. In one non-limiting embodiment, the support members 502, 503 and the crossmember 504 have a total length (l) dimension that is generally equal to or less than 75 millimeters (mm). In one non-limiting embodiment, each support member has a width (w) dimension measurable from a proximal end 502*a* to a distal end 502*b* that is generally equal to or less than 40 mm.

The crossmember 504 of baffle 205 is has a width dimension that is less than the width dimension of the two support members 502, 503 such that when baffle 205 is operably coupled to at least one opposite end wall 203, an orifice 507 is formed. In one non-limiting embodiment, the orifice 507 has a length (a) dimension as measured from the medial facing side of each support member 502, 503 that is generally equal to or less than 45 mm. In one non-limiting embodiment, the orifice 507 has a depth (d) dimension measured from the proximal end 502*a* to an interior surface 504*a* of the crossmember 504 that is generally equal to or less than 20 mm. The orifice 507 permits a portion of the fluid from the distributor 30, to flow through to the first interior 21. The orifice 507 may have the further benefit of minimizing any potential pressure increase as fluid flows from the distributor 30 to the first interior 21.

It should be appreciated that the length (l) & width (w) dimensions disclosed above, can be varied (increased or decreased) to control the flow deflection toward central portion depending on the desired result and design needs.

FIGS. 2, 3, 6 and 7 show various views of a plurality of baffles 205 is in accordance with embodiments of the disclosure. In one non-limiting embodiment, a plurality of baffles 205 are operably coupled to at least one opposite end wall 203 as illustrated in FIG. 2. In some embodiments, baffles 205 may be on both opposite end walls 203 as illustrated in the side view of FIG. 3 and the top view of FIG. 6. In some embodiments, the baffles 205 may be coupled to the internal portion of the shell 20, for example, within the first interior 21 (not shown).

Figure 7:
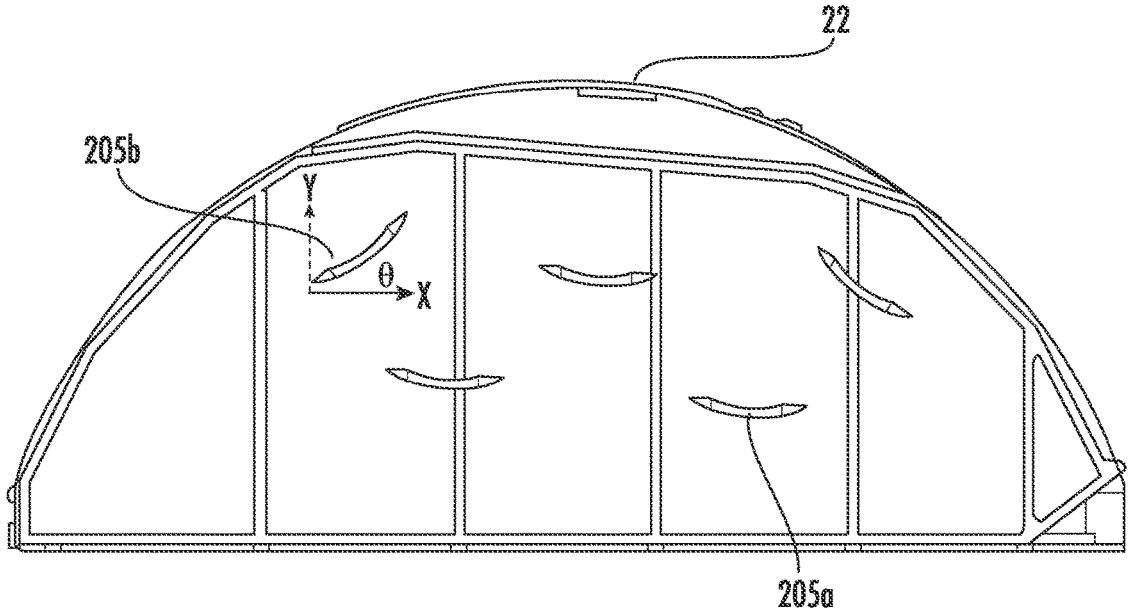
FIG. 7 is a partial axial view of the baffle of the oil separator in accordance with embodiments of the disclosure.

Referring to FIG. 7, an axial view of the oil separator is provided to illustrate one non-limiting embodiment of the plurality of baffles 205 as coupled to at least one opposite end wall 203, however omitting other details such as the distributor, for clarity. Referring to FIG. 7, the vertical plane of the opposite end wall 203 may be described in terms of x, y coordinates, having an x-axis and a y-axis. In some embodiments, the position of a baffle 205 along the plane of the opposite end wall 203, may be generally perpendicular to the y-axis, as illustrated by baffle 205*a*. In some embodiments, the position of a baffle may be at an angle (θ) generally less than forty-five degrees (45° from the x-axis as illustrated by baffle 205*b*.

The number of baffles 205 coupled to at least one opposite end wall 203, and the spacing between baffles 205, may vary based on a variety factors, including size of the oil separator 12, the rate of fluid flow through the oil separator, and the location of the first opening 22.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An oil separator, comprising:

an exterior shell having opposite end walls defining a first interior, and a first and second opening fluidly communicative with the first interior, a distributor integrated within the exterior shell to define a second interior within the first interior;

a plurality of baffles operably coupled to and extending from at least a first opposite end wall, each baffle comprising:

a first support member generally parallel to a second support member, each operably coupled, and in an orientation that is generally perpendicular, to at least the first opposite end wall; and a crossmember operably coupled between the first support member and the second support member, the crossmember having a width dimension that is less than the width dimension of the first support member and the second support member, forming an orifice between the crossmember and the at least first opposite end wall.

2. The oil separator of claim 1, wherein at least one of the crossmember, the first support member and the second support member comprises a concave surface for deflecting the flow of a fluid.

3. The oil separator of claim 1, wherein the internal width of the orifice between the support members comprises a dimension of less than or equal to about 45 millimeters.

4. The oil separator of claim 1, wherein the internal depth of the orifice between the crossmember and the at least first opposite end wall comprises a dimension of less than or equal to about 20 millimeters.

5. The oil separator of claim 1, wherein the width of the baffle across the support members and the crossmember comprise a dimension of less than or equal to about 75 millimeters.

6. The oil separator of claim 1, wherein the length of a support member comprises a dimension of less than or equal to about 40 millimeters.

7. The oil separator of claim 1, wherein the distributor having a length, which is slightly less than that of the exterior shell, being disposed to define opposite spaces between a first opposite end and a second opposite end thereof and the opposite end walls and being sealed to the exterior shell along the length to form first and second passageways from the first opening to the opposite spaces.

8. The oil separator of claim 1, wherein a first filter media cartridge and a second filter media cartridge are disposed within the first interior between the opposite spaces and the second opening.

9. A flow component for an oil separator comprising:

an end wall defining an exterior shell of an oil separator having an integrated distributor disposed within the oil separator; and a plurality of baffles operably coupled to and extending from the end wall, each baffle comprising:

a first support member generally parallel to a second support member, each operably coupled, and in an orientation that is generally perpendicular, to at least the first opposite end wall, and a crossmember operably coupled between the first support member and the second support member, the crossmember having a width dimension that is less than the width dimension of the first support member and the second support member, forming an orifice between the crossmember and the at least first opposite end wall.

10. The flow component of claim 9, wherein at least one of wherein at least one of the crossmember, the first support member and the second support member comprises a concave surface for deflecting the flow of a fluid.

11. The flow component of claim 9, wherein the internal width of the orifice between the support members comprises a dimension of less than or equal to about 45 millimeters.

12. The flow component of claim 9, wherein the internal depth of the orifice between the crossmember and the opposite end wall comprises a dimension of less than or equal to about 20 millimeters.

13. The flow component of claim 9, wherein the width of the baffle across the support members and the crossmember comprise a dimension of less than or equal to about 75 millimeters.

14. The flow component of claim 9, wherein the length of a support member comprises a dimension of less than or equal to about 40 millimeters.

15. A chiller assembly comprising:

a compressor;

an oil separator comprising:

an exterior shell having opposite end walls defining a first interior, and a first and second opening fluidly communicative with the first interior, a distributor integrated within the exterior shell to define a second interior within the first interior;

a plurality of baffles operably coupled to and extending from at least a first opposite end wall, each baffle comprising:

a first support member generally parallel to a second support member, each operably coupled, and in an orientation that is generally perpendicular, to at least the first opposite end wall, and a crossmember operably coupled between the first support member and the second support member, the crossmember having a width dimension that is less than the width dimension of the first support member and the second support member, forming an orifice between the crossmember and the at least first opposite end wall.

16. The chiller assembly of claim 15 further comprising a single discharge pipe sub-assembly fluidly interposed between the compressor and the oil separator.

17. The chiller assembly of claim 15 wherein the distributor comprises a cross-sectional area which is substantially similar to that of the single discharge pipe sub-assembly.

18. The chiller assembly of claim 15, wherein at least one of the crossmember, the first support member and the second support member comprises a concave surface for deflecting the flow of a fluid.

19. The chiller assembly of claim 15, wherein the internal width of the orifice between the support members comprises a dimension of less than or equal to about 45 millimeters.

20. The chiller assembly of claim 15, wherein the internal depth of the orifice between the crossmember and the opposite end wall comprises a dimension of less than or equal to about 20 millimeters.

* * * * *